US009898980B2

(12) United States Patent
Kwon et al.

(10) Patent No.: US 9,898,980 B2
(45) Date of Patent: Feb. 20, 2018

(54) DISPLAY APPARATUS

(71) Applicant: SAMSUNG DISPLAY CO., LTD., Yongin, Gyeonggi-Do (KR)

(72) Inventors: Ho-Kyoon Kwon, Seoul (KR); Myoung-Soo Kim, Seoul (KR); Sang-Ik Lee, Seoul (KR); Kyoung-Ho Lim, Suwon-si (KR); Kwang-Chul Jung, Seongnam-si (KR); Jun-Ki Jeong, Anyang-si (KR); Ki-Seok Cha, Yongin-si (KR); Joon-Chul Goh, Hwaseong-si (KR); Bong-Hyun You, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 121 days.

(21) Appl. No.: 14/702,611

(22) Filed: May 1, 2015

(65) Prior Publication Data

US 2016/0133214 A1 May 12, 2016

(30) Foreign Application Priority Data

Nov. 10, 2014 (KR) ..... 10-2014-0155645

(51) Int. Cl.
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2310/0281* (2013.01)

(58) Field of Classification Search
CPC ..... G09G 3/3648; G09G 3/3614; G09G 2310/0281
See application file for complete search history.

(56) References Cited

U.S. PATENT DOCUMENTS

| | | | | |
|---|---|---|---|---|
| 6,496,238 | B1 | 12/2002 | Greene et al. | |
| 8,363,192 | B2 * | 1/2013 | Takahashi | G02F 1/1345 349/139 |
| 2008/0074404 | A1 * | 3/2008 | Sashida | G09G 3/3648 345/204 |
| 2009/0002283 | A1 * | 1/2009 | Park | H01L 27/3276 345/76 |
| 2010/0295764 | A1 * | 11/2010 | Wang | G02F 1/136286 345/92 |

(Continued)

FOREIGN PATENT DOCUMENTS

| | | | |
|---|---|---|---|
| KR | 10-2005-0038119 | A | 4/2005 |
| KR | 10-2005-0065784 | A | 6/2005 |
| KR | 10-2009-0005617 | A | 1/2009 |

*Primary Examiner* — Charles Hicks
(74) *Attorney, Agent, or Firm* — Lewis Roca Rothgerber Christie LLP

(57) ABSTRACT

A display apparatus includes a plurality of pixels arranged in columns and rows in a display area, a data line extending in a first direction and connected with pixels of a k-th column ('k' is a natural number) and a (k+1)-th column, a gate line extending in a second direction crossing the first direction and connected with ones of the pixels, a gate signal line extending in the first direction and connected with the gate line, and a gate driver in a first peripheral area adjacent to a first longer side of the display area and having a first width, and configured to apply a gate signal to the gate line.

19 Claims, 8 Drawing Sheets

(56) References Cited

U.S. PATENT DOCUMENTS

| | | | | |
|---|---|---|---|---|
| 2011/0102309 | A1* | 5/2011 | Cho | G09G 3/3648 345/92 |
| 2012/0098871 | A1* | 4/2012 | Park | G09G 3/3607 345/690 |
| 2012/0120020 | A1* | 5/2012 | Lee | G06F 3/0412 345/174 |
| 2015/0029080 | A1* | 1/2015 | Kwon | G09G 3/3648 345/90 |
| 2015/0084946 | A1* | 3/2015 | Shim | G09G 3/3258 345/212 |
| 2015/0379950 | A1* | 12/2015 | Sun | G09G 3/3614 345/87 |

* cited by examiner

DISPLAY APPARATUS

CROSS-REFERENCE TO RELATED APPLICATION

This application claims priority to and the benefit of Korean Patent Application No. 10-2014-0155645, filed on Nov. 10, 2014 in the Korean Intellectual Property Office (KIPO), the content of which is herein incorporated by reference in its entirety.

BACKGROUND

1. Field

Exemplary embodiments of the present inventive concept relate to a display apparatus.

2. Description of the Related Art

Generally, a liquid crystal display (LCD) panel includes a thin film transistor (TFT) substrate, an opposing substrate, and a LC (liquid crystal) layer. The TFT substrate includes a plurality of gate lines, a plurality of data lines crossing the gate lines, a plurality of TFTs connected with the gate lines and data lines, and a plurality of pixel electrodes connected with the TFTs. Each TFT includes a gate electrode extending from the gate line, a source electrode extending to the data line, and a drain electrode spaced from the source electrode.

Generally, a liquid crystal display panel includes a display area and a peripheral area. An image is displayed in the display area. A gate driver (e.g., a gate driving part) and a data driver (e.g., a data driving part) are disposed in the peripheral area. In addition, the gate lines extend in a horizontal direction, and the data lines extend in a vertical direction. Therefore, the gate drivers may be disposed in the peripheral area adjacent to a right side and a left side of the display area. Furthermore, the data driver may be in the peripheral area adjacent to a lower side of the display area.

In terms of technology and design interesting to consumers, recently, research and development of flat panel display apparatuses has increased. Therefore, efforts are continuously being made to reduce or minimize (e.g., slim) the thicknesses of display apparatuses, and research is increasingly being conducted on a design with enhanced aesthetic beauty that can induce consumers to buy the display by appealing to the consumer's sense of beauty. In addition, efforts are continuously being made to reduce or minimize the width of a bezel of the display apparatus.

However, because the gate drivers are disposed in the peripheral area adjacent to the right side and the left side of the display area, it is difficult to reduce or minimize the width of a bezel of the display apparatus.

SUMMARY

Exemplary embodiments of the present inventive concept provide a display apparatus having a reduced bezel width.

In an exemplary embodiment of a display apparatus according to the present inventive concept, the display apparatus includes a plurality of pixels arranged in columns and rows in a display area, a data line extending in a first direction and connected with pixels of a k-th column ('k' is a natural number) and a (k+1)-th column, a gate line extending in a second direction crossing the first direction and connected with ones of the pixels, a gate signal line extending in the first direction and connected with the gate line and a gate driver in a first peripheral area adjacent to a first longer side of the display area and having a first width, and configured to apply a gate signal to the gate lines.

In an exemplary embodiment, the display apparatus may further include a second peripheral area adjacent to a second longer side opposite the first longer side of the display area and having a second width, a third peripheral area adjacent to a first shorter side extending between the first longer side and the second longer side of the display area and a fourth peripheral area adjacent to a second shorter side extending between the first longer side and the second longer side of the display area.

In an exemplary embodiment, the first width may be greater than the second width.

In an exemplary embodiment, the gate signal line may be at the same layer as the data line.

In an exemplary embodiment, the display apparatus may further include a common line extending in the first direction and arranged between the pixels.

In an exemplary embodiment, the data line, the gate signal line, and the common line may be sequentially arranged between adjacent pixel columns.

In an exemplary embodiment, the display apparatus may further include a data driver in the first peripheral area and configured to apply a data signal to the data line.

In an exemplary embodiment of a display apparatus according to the present inventive concept, the display apparatus includes a plurality of pixels arranged in columns and rows in a display area, a data line extending in a first direction and connected with pixels of a k-th column ('k' is a natural number) and a (k+1)-th column in an odd-numbered row, and connected with pixels of a (k−1)-th column and a (k+2)-th column in an even-numbered row, a gate line extending in a second direction crossing the first direction and connected with ones of the pixels, a gate signal line extending in the first direction and connected with the gate line and a gate driver in a first peripheral area adjacent to a first longer side of the display area and having a first width, and configured to apply a gate signal to the gate line.

In an exemplary embodiment, the display apparatus may further include a second peripheral area adjacent to a second longer side opposite the first longer side of the display area and having a second width, a third peripheral area adjacent to a first shorter side extending between the first longer side and the second longer side of the display area and a fourth peripheral area adjacent to a second shorter side extending between the first longer side and the second longer side of the display area.

In an exemplary embodiment, the first width may be greater than the second width.

In an exemplary embodiment, the gate signal line may be at the same layer as the data line.

In an exemplary embodiment, the display apparatus may further include a common line extending in the first direction and between the pixels.

In an exemplary embodiment, the gate signal line, and the common line may be sequentially arranged between adjacent pixel rows.

In an exemplary embodiment, the display apparatus may further include a data driver in the first peripheral area and configured to apply a data signal to the data line.

In an exemplary embodiment of a display apparatus according to the present inventive concept, the display apparatus includes a plurality of pixels arranged in columns and rows in a display area, an m-th data line ('m' is a natural number) connected with pixels of a (k−1)-th column ('k' is a natural number) and a (k+1)-th column in an odd-numbered row, and connected with pixels of a k-th column and a (k+2)-th column in an even-numbered row, an (m+1)-th data line connected with pixels of a (k+2)-th column and a (k+4)-th column in an odd-numbered row, and connected with pixels of a (k+1)-th column and a (k+3)-th column in an even-numbered row, a gate line extending in a second direction crossing the first direction and connected with ones of the pixels, a gate signal line extending in the first direction and connected with the gate line and a gate driver in a first peripheral area adjacent to a first longer side of the display area and having a first width, and configured to apply a gate signal to the gate line.

In an exemplary embodiment, the display apparatus may further include a second peripheral area adjacent to a second longer side facing the first longer side of the display area and having a second width, a third peripheral area adjacent to a first shorter side connecting the first longer side and the second longer side of the display area and a fourth peripheral area adjacent to a second shorter side connecting the first longer side and the second longer side of the display area.

In an exemplary embodiment, the first width may be greater than the second width.

In an exemplary embodiment, the display apparatus may further include a common line extending in the first direction and between the pixels.

In an exemplary embodiment, the m-th data line, the gate signal line, and the common line may be sequentially arranged between adjacent pixel rows.

In an exemplary embodiment, the display apparatus may further include a data driver in the first peripheral area and configured to apply a data signal to the data line.

According to one or more exemplary embodiments, a display apparatus includes a gate signal line extending in a direction parallel with an extension direction of a data line. The gate signal line is disposed on the same layer as the data line. The gate signal line transfers a gate signal to a gate line. Thus, a gate driver and a data driver may both be disposed on a peripheral area adjacent to a first longer side of the display area.

Because the data driver and the gate driver are both disposed in the first peripheral area adjacent to a first longer side of the display area, no driver (e.g., neither the data driver nor the gate driver) is disposed in the second peripheral area, the third peripheral area, or the fourth peripheral area. Thus, widths of the second peripheral area, the third peripheral area, and the fourth peripheral area may be reduced (e.g., narrowed). Accordingly, widths of three sides of a display panel may be reduced or minimized.

BRIEF DESCRIPTION OF THE DRAWINGS

The above and other features and characteristics of the present inventive concept will become more apparent by describing, in detail, exemplary embodiments thereof with reference to the accompanying drawings, in which.

DETAILED DESCRIPTION

Figure 1:
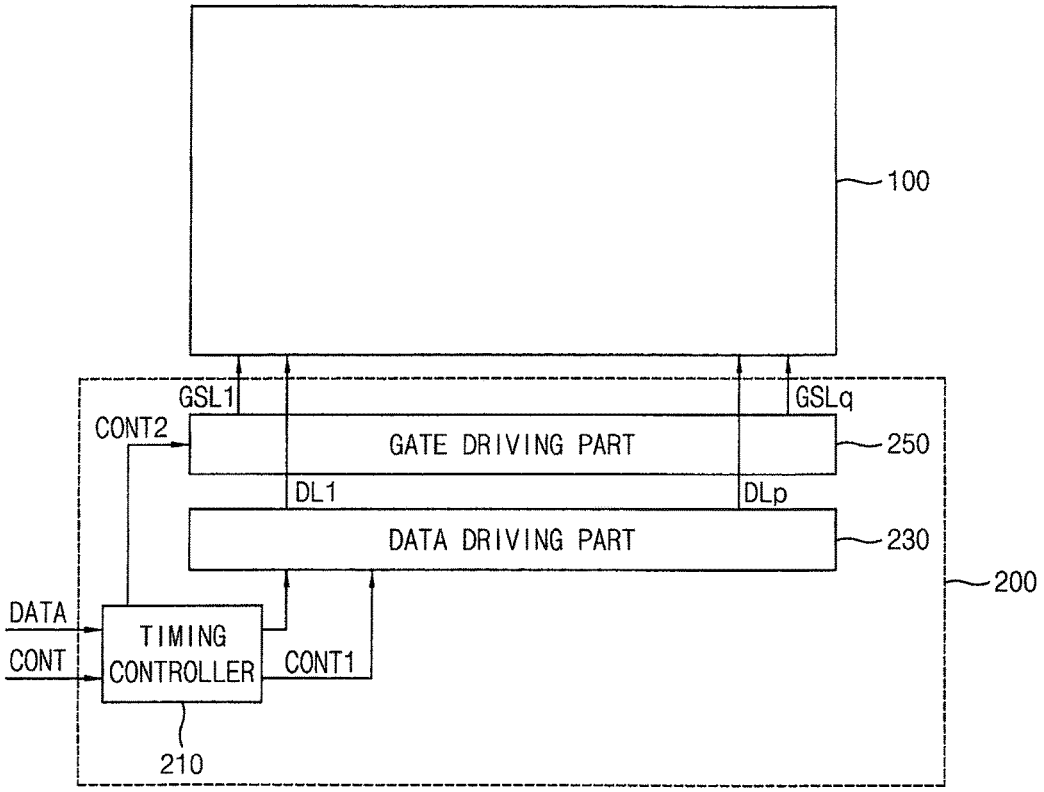
FIG. 1 is a block diagram illustrating a display apparatus according to an exemplary embodiment of the present inventive concept.

Hereinafter, exemplary embodiments of the present invention will be explained in detail with reference to the accompanying drawings.

It will be understood that when an element or layer is referred to as being "on", "connected to", or "coupled to" another element or layer, it may be directly on, connected, or coupled to the other element or layer or one or more intervening elements or layers may also be present. When an element is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements. The same reference numerals designate the same elements. As used herein, the term "and/or" includes any and all combinations of one or more of the associated listed items. Further, the use of "may" when describing embodiments of the present invention relates to "one or more embodiments of the present invention". Expressions, such as "at least one of," when preceding a list of elements, modify the entire list of elements and do not modify the individual elements of the list. Also, the term "exemplary" is intended to refer to an example or illustration.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly. As used herein, the terms "use," "using," and "used" may be considered synonymous with the terms "utilize," "utilizing," and "utilized," respectively.

The terminology used herein is for the purpose of describing particular example embodiments only and is not intended to be limiting of example embodiments. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

The gate driver, data driver, and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the gate driver and/or the data driver may be formed on one integrated circuit (IC) chip or on separate IC chips. Further, the various components of the gate driver and/or the data driver may be implemented on a flexible printed circuit film, a tape carrier package (TCP), a printed circuit board (PCB), or formed on a same substrate as the gate driver and/or the data driver. Further, the various components of the gate driver and/or the data driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Figure 2:
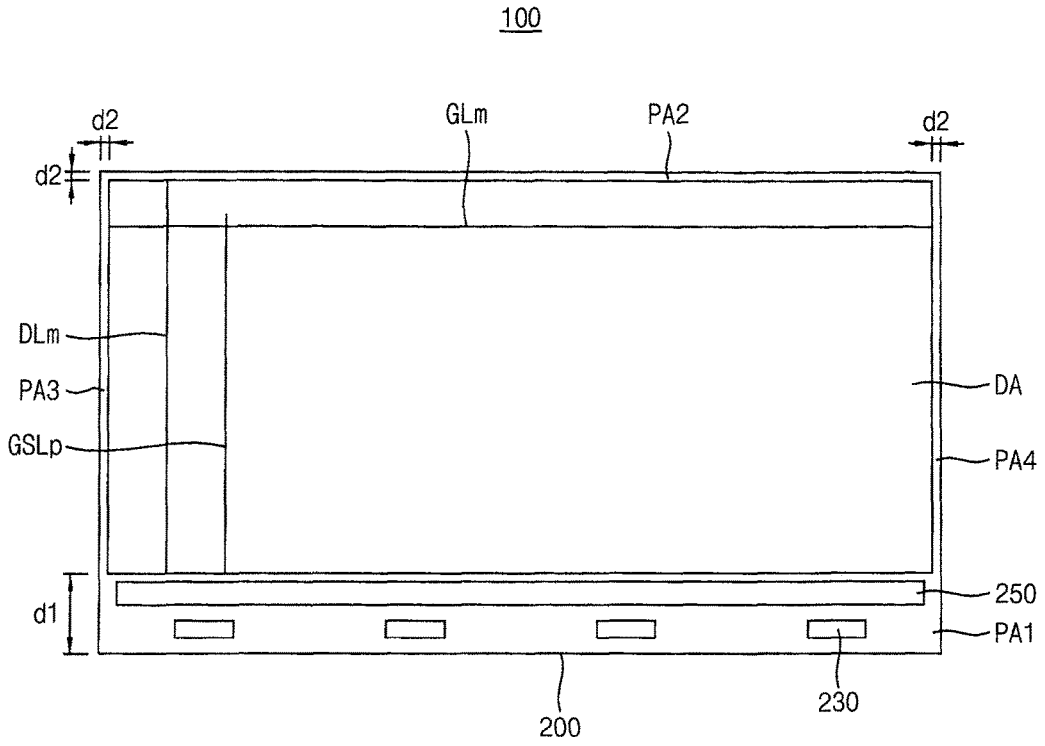
FIG. 2 is a plan view illustrating a display panel according to an exemplary embodiment of the present inventive concept.

FIG. 1 is a block diagram illustrating a display apparatus according to an exemplary embodiment of the present inventive concept. FIG. 2 is a plan view illustrating a display panel according to an exemplary embodiment of the present inventive concept.

Referring to FIGS. 1 and 2, a display device includes a display panel 100 and a panel driver 200 (e.g., a panel driving part) on or adjacent to the display panel 100 and configured to drive the display panel 100.

The display panel 100 may have a frame shape (e.g., a rectangular shape) having longer sides extending in a first direction D1 and shorter sides extending in a second direction D2 substantially crossing (e.g., perpendicular to) the first direction D1. A plurality of gate lines and a plurality of data lines crossing the gate lines are formed on the display panel 100.

The gate lines extend in the first direction D1, that is, a longer side direction of the display panel 100, and are arranged along the second direction D2. The data lines extend in the second direction D2, that is, a shorter side direction of the display panel 100, and are arranged along the first direction D1.

The display panel 100 includes a plurality of pixels which are arranged along the first direction D1 and the second direction D2 crossing the first direction D1 (e.g., are arranged in a matrix). The pixels may include red pixels, green pixels, and blue pixels. As used herein, the term "pixels" may denote pixels (including multiple sub-pixels) or sub-pixels as those skilled in the art would appreciate from the context of the disclosure. Each of the pixels is periodically disposed on the display panel 100.

The panel driver 200 includes a timing controller 210 (e.g., a timing control part), a data driver 230 (e.g., a data driving part), and a gate driver 250 (e.g., a gate driving part).

The timing controller 210 receives a data signal DATA and a control signal CONT from an external device. The control signal CONT may include one or more of a main clock signal MCLK, a vertical synchronizing signal VSYNC, a horizontal synchronizing signal HSYNC, a data enable signal DE, etc.

The timing controller 210 generates a first control signal CONT1 for controlling a driving timing of the data driver 230 and a second control signal CONT2 for controlling a driving timing of the gate driver 250 by using (e.g., according to) the control signal CONT. The first control signal CONT1 may include one or more of a horizontal start signal STH, a load signal TP, a data clock signal DCLK, an inversion signal POL, etc. The second control signal CONT2 may include one or more of a vertical start signal STV, a gate clock signal GCLK, an output enable signal OE, etc.

The data driver 230 is disposed at a longer side portion of the display panel 100 (e.g., at a bottom side of the display panel 100) and outputs data voltage to the data lines. The data driver 230 converts a digital data signal DATA provided from the timing controller 210 into an analog data voltage and outputs the analog data voltage to the data lines. The data driver 230 inverses the polarity of the data voltage in response to (e.g., according to) an inversion signal provided from the timing controller 210 and outputs the inversed data voltage to the data lines.

The data driver 230 applies data signals to a plurality of data lines formed on the display panel 100. For example, during an N-th frame, the data driver 230 applies a data signal having a negative polarity (−) to an m-th data line DLm and applies a data signal having a positive polarity (+) to an (m−1)-th data line DLm−1 and an (m+1)-th data line DLm+1 adjacent to the m-th data line DLm, respectively. Then, during an (N+1)-th frame, the data driver 230 applies data signals having a polarity opposite to that of respective data signals applied during the N-th frame. Thus, the data driver 230 may drive the display panel 100 using a column inversion driving method. In this embodiment, 'm' and 'N' are natural numbers.

However, the present invention is not limited thereto, and the positive pixel voltage and the negative pixel voltage may be alternately applied to each subpixel along the respective data lines. The above-explained driving method is called a dot inversion method. During a first frame, a positive pixel voltage, a negative pixel voltage, a positive pixel voltage, and a negative pixel voltage may be sequentially applied to a first subpixel column connected to a first data line. During a second frame, a negative pixel voltage, a positive pixel voltage, a negative pixel voltage, and a positive pixel voltage may be sequentially applied to the first subpixel column connected to the first data line.

The gate driver 250 is disposed at the longer side portion (e.g., a first longer side portion) of the display panel 100 and sequentially outputs gate signals to the gate lines. The gate driver 250 generates gate signals by using (e.g., based on or according to) the second control signal CONT2 and gate on/off voltages provided from a voltage generating part.

The gate driver 250 sequentially applies gate signals to a plurality of gate signal lines GSLp formed on the display panel 100. The gate signal lines GSLp are electrically connected with the gate lines GLn. The gate signal lines GSLp extend in a direction parallel to an extension direction of the data lines DLm. The gate lines GLn extend in a direction crossing an extension direction of the data lines DLm. The gate signal lines GSLp transfer the gate signals from the gate driver 250 to the gate lines GLn.

The display panel 100 according to an exemplary embodiment of the present inventive concept has a display area DA and a peripheral area PA. The peripheral area PA may include first to fourth peripheral areas PA1, PA2, PA3, and PA4.

The first peripheral area PA1 is disposed adjacent to a first longer side of the display area DA. The first peripheral area PA1 may have a first width d1. The data driver 230 and the gate driver 250 may be disposed in the first peripheral area PA1.

The second peripheral area PA2 is disposed adjacent to a second longer side opposite the first longer side of the display area DA. The second peripheral area PA2 may have a second width d2. The third peripheral area PA3 is disposed adjacent to a first shorter side connecting (e.g., extending between) the first longer side and the second longer side of the display area DA. The third peripheral area PA3 may have the second width d2. The fourth peripheral area PA4 is disposed adjacent to a second shorter side connecting the first longer side and the second longer side of the display area DA. The fourth peripheral area PA4 may have the second width d2. The first width d1 may be greater than the second width d2.

According to the present exemplary embodiment, the data driver 230 and the gate driver 250 are disposed in the first peripheral area PA1. In addition, no driving part is disposed in the second peripheral area PA2, the third peripheral area PA3, and/or the fourth peripheral area PA4. Thus, widths of the second peripheral area PA2, the third peripheral area PA3, and the fourth peripheral area PA4 may be reduced (e.g., narrowed). Accordingly, widths of three sides of a display panel may be reduced or minimized.

Figure 3:
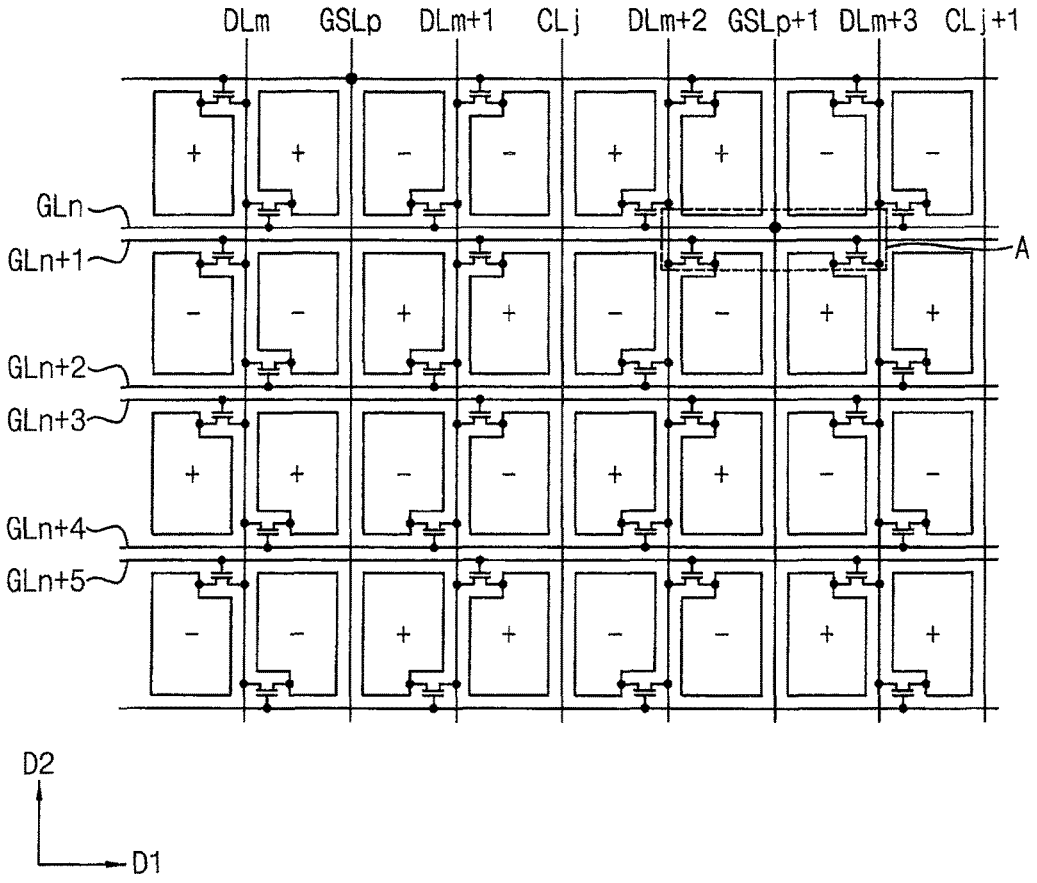
FIG. 3 is a schematic diagram illustrating a structure of pixels of a display apparatus according to an exemplary embodiment of the present inventive concept.

FIG. 3 is a schematic diagram illustrating a structure of pixels of a display apparatus according to an exemplary embodiment of the present inventive concept.

Referring to FIG. 3, a display apparatus according to an exemplary embodiment of the present inventive concept includes a plurality of pixels arranged along a column direction and a row direction (e.g., in a matrix) and disposed in a display area, a plurality of gate lines GLn extending in a first direction D1 and connected with the pixels, a plurality of data lines DLm extending in a second direction D2 crossing the first direction D1 and connected with the pixels, a plurality of gate signal lines GSLp extending in the second direction D2 and connected with the gate lines GLn, and a plurality of common lines CLj extending in the second direction D2.

The gate lines GLn extend in the first direction D1 and are arranged along the second direction D2. Two gate lines may be disposed between the pixel rows (e.g., between each adjacent pair of the pixel rows). For example, an n-th gate line ('n' is a natural number) and an (n+1)-th gate line are disposed between (e.g., in a same space between) two pixel rows. The gate lines GLn may have a single layer structure including copper (Cu), silver (Ag), chromium (Cr), molybdenum (Mo), aluminum (Al), titanium (Ti), manganese (Mn), or a combination thereof. In addition, the gate lines GLn may have a multi-layer structure having a plurality of layers including materials different from each other. For example, the gate lines GLn may include a copper layer and a titanium layer disposed on and/or under the copper layer.

The data lines DLm extend in the second direction D2 crossing the gate lines GLn. The data lines DLm are disposed after every two pixel columns. In other words, two adjacent data lines are separated from each other by two pixel columns (e.g., two pixel columns share each of the data lines DLm). One of the data lines DLm is connected with pixels of a k-th column ('k' is a natural number) and a (k+1)-th column. The data lines DLm may have a single layer structure including copper (Cu), silver (Ag), chromium (Cr), molybdenum (Mo), aluminum (Al), titanium (Ti), manganese (Mn), or a combination thereof. In addition, the data lines DLm may have a multi-layer structure having a plurality of layers including materials different from each other. For example, the data lines DLm may include a copper layer and a titanium layer disposed on and/or under the copper layer.

The positive pixel voltage and the negative pixel voltage may be alternately applied to each subpixel along each data line. During a first frame, a positive pixel voltage, a negative pixel voltage, a positive pixel voltage, and a negative pixel voltage may be sequentially applied to a first subpixel column connected to a first data line. During a second frame, a negative pixel voltage, a positive pixel voltage, a negative pixel voltage, and a positive pixel voltage may be sequentially applied to the first subpixel column connected to the first data line. Accordingly, data voltages having different polarities, such as in a sequence of "+, −, +, −, +", are applied to the pixel column, and data voltages having different polarities, such as in a sequence of "+, +, −, −, +, +, −, −", are applied to the pixel row.

The gate signal lines GSLp extend in a direction parallel with an extension direction of the data lines DLm The gate line GLn extends in a direction crossing an extension direction of the data line DLm. The gate signal lines GSLp transfer the gate signals from the gate driver 250 to the gate lines GLn. The gate signal lines GSLp are disposed between (e.g., in a space between) the pixel columns in which the data lines DLm are not disposed. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer.

The common lines CLj extend in the second direction D2. A common voltage is applied to the common lines CLj. The common lines CLj are disposed between (e.g., in a space between) the pixel columns in which the data lines DLm are not disposed. The common lines CLj may have a single layer structure including copper (Cu), silver (Ag), chromium (Cr), molybdenum (Mo), aluminum (Al), titanium (Ti), manganese (Mn), or a combination thereof. In addition, the common lines CLj may have a multi-layer structure having a plurality of layers including materials different from each other. For example, the common lines CLj may include a copper layer and a titanium layer disposed on and/or under the copper layer.

The data lines DLm, the gate signal lines GSLp, and the common lines CLj are disposed between the pixels one by one (e.g., only one of the respective data lines DLm, gate signal lines GSLp, and the common line CLj is between any two adjacent pixel columns). In addition, the various lines are disposed in the following sequence between the pixels: one of the data lines DLm, one of the gate signal lines GSLp, another one of the data lines DLm, and the common line CLj. That is, one of the data lines DLm is disposed every two pixel columns, and one of the gate signal lines GSLp and one of the common lines CLj are disposed every four pixel columns.

Figure 4:
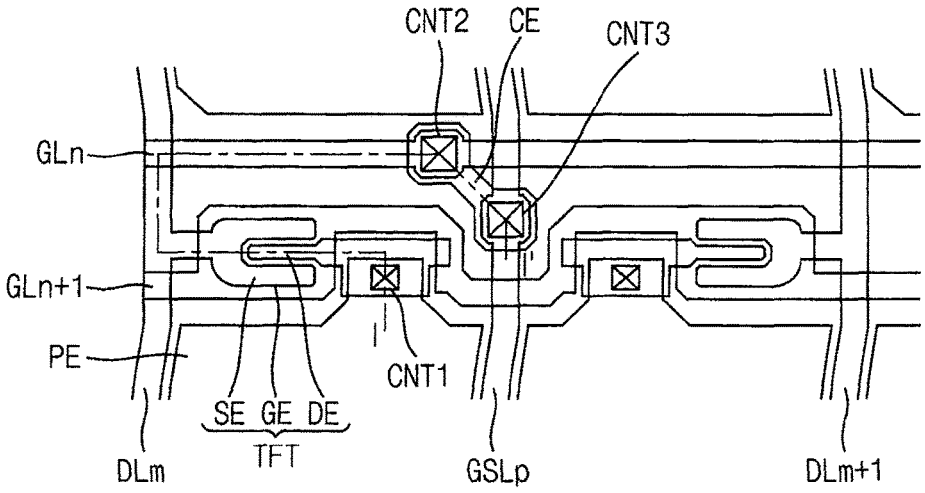
FIG. 4 is a plan view magnifying the portion "A" of FIG. 3.
Figure 5:
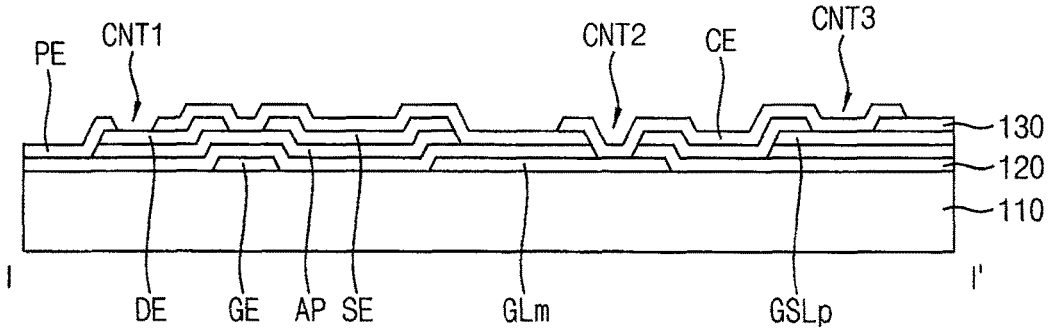
FIG. 5 is a cross-sectional view taken along the line I-I of FIG. 4.

FIG. 4 is a plan view magnifying the portion "A" of FIG. 3. FIG. 5 is a cross-sectional view taken along the line I-I' of FIG. 4.

Referring to FIGS. 4 and 5, a display apparatus according to an exemplary embodiment of the present inventive concept includes a plurality of gate lines GLn, a plurality of data lines DLm, a plurality of switching elements TFT, a plurality of gate signal lines GSLp, and a plurality of pixel electrodes PE. Each of the switching elements TFT may include a gate electrode GE, a source electrode SE, and a drain electrode DE.

The gate lines GLn and the gate electrodes GE are formed on a base substrate 110. For example, a gate metal layer is formed on the base substrate 110 and patterned to form the gate line GLn and the gate electrode GE. That is, the gate metal pattern may include the gate line GLn and the gate electrode GE.

Examples of the base substrate 110 may include a glass substrate, a quartz substrate, a silicon substrate, a plastic substrate, and/or the like.

The gate lines GLn extend in the first direction D1. The gate lines GLn may have a single layer structure including copper (Cu), silver (Ag), chromium (Cr), molybdenum (Mo), aluminum (Al), titanium (Ti), manganese (Mn), or a combination thereof. In addition, the gate lines GLn may have a multi-layer structure having a plurality of layers including materials different from each other. For example, the gate lines GLn may include a copper layer and a titanium layer disposed on and/or under the copper layer. The gate lines GLn are electrically connected to respective gate electrodes GE of the switching elements TFT. In other embodiments, portions of the gate lines GLn may form respective gate electrodes GE.

The first insulation layer 120 is formed on the gate lines GLn and the gate electrodes GE. The first insulation layer 120 may include an inorganic material, such as silicon oxide ($SiO_x$) and/or silicon nitride ($SiN_x$). For example, in one embodiment, the first insulation layer 120 includes silicon oxide ($SiO_x$) and may have a thickness of about 500 Å. In addition, the first insulation layer 120 may include a plurality of layers including different materials from each other.

An active pattern AP is formed on the first insulation layer 120. The active pattern AP may include a semiconductor pattern and an ohmic contact pattern. The ohmic contact pattern is formed on the semiconductor pattern. The semiconductor pattern may include a silicon semiconductor material. For example, the semiconductor pattern may include amorphous silicon (a-Si:H). The ohmic contact pattern may be interposed between the semiconductor pattern and a source electrode SE and may be interposed between the semiconductor pattern and a drain electrode DE. The ohmic contact pattern may include n+ amorphous silicon (n+ a-Si:H).

The data metal pattern may be disposed on the active pattern AP. The data metal pattern may include the data line DL, the source electrode SE, and the drain electrode DE. The data metal pattern may have a single layer structure including copper (Cu), silver (Ag), chromium (Cr), molybdenum (Mo), aluminum (Al), titanium (Ti), manganese (Mn), or a combination thereof. In addition, the data metal pattern may have a multi-layer structure having a plurality of layers including materials different from each other.

The gate signal lines GSLp are disposed on the same layer as the data lines DLm. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer. The gate signal lines GSLp extend in a direction parallel with an extension direction of the data lines DLm.

A second insulation layer 130 may be formed on the data metal pattern. The second insulation layer 130 may include an inorganic material, such as silicon oxide ($SiO_x$) and/or silicon nitride ($SiN_x$). For example, in one embodiment, the second insulation layer 130 includes silicon oxide ($SiO_x$) and may have a thickness of about 500 Å. In other embodiments, the second insulation layer 130 may include a plurality of layers including different materials from each other.

The pixel electrode PE and a connecting electrode CE are formed on the second insulation layer 130.

The pixel electrode PE may include a transparent conductive material, such as indium tin oxide (ITO) and/or indium zinc oxide (IZO). In addition, the pixel electrode PE may include titanium (Ti) and/or molybdenum titanium (MoTi). The pixel electrode PE is electrically connected with the drain electrode DE through a first contact opening CNT1 (e.g., a first contact hole). The first contact opening CNT1 is formed through (e.g., extends through) the second insulation layer 130.

The connecting electrode CE may include a transparent conductive material, such as indium tin oxide (ITO) and/or indium zinc oxide (IZO). In addition, the connecting electrode CE may include titanium (Ti) and/or molybdenum titanium (MoTi). The connecting electrode CE connects the gate line GLn and the gate signal line GSLp through a second contact opening CNT2 (e.g., a second contact hole) and a third contact opening CNT3 (e.g., a third contact hole). The second contact opening CNT2 is formed through the first insulation layer 120 and the second insulation layer 130. The third contact opening CNT3 is formed through the second insulation layer 130.

According to the present exemplary embodiment, the gate signal lines GSLp are disposed between the pixel columns in which the data lines DLm are not disposed. The gate signal lines GSLp extend in the second direction D2, parallel with an extension direction of the data lines DLm. In addition, the gate signal lines GSLp are disposed on the same layer as the data lines DLm to be electrically connected with the gate line GLn. Thus, the gate signal lines GSLp transfer the gate signals from the gate driver to the gate lines GLn.

Therefore, the data driver and the gate driver are disposed in the first peripheral area adjacent to the first longer side of the display area. In addition, no driver is disposed in the second peripheral area, the third peripheral area, or the fourth peripheral area. Thus, widths of the second peripheral area, the third peripheral area, and the fourth peripheral area may be reduced (e.g., narrowed). Accordingly, widths of three sides of a display panel may be reduced or minimized.

Figure 6:
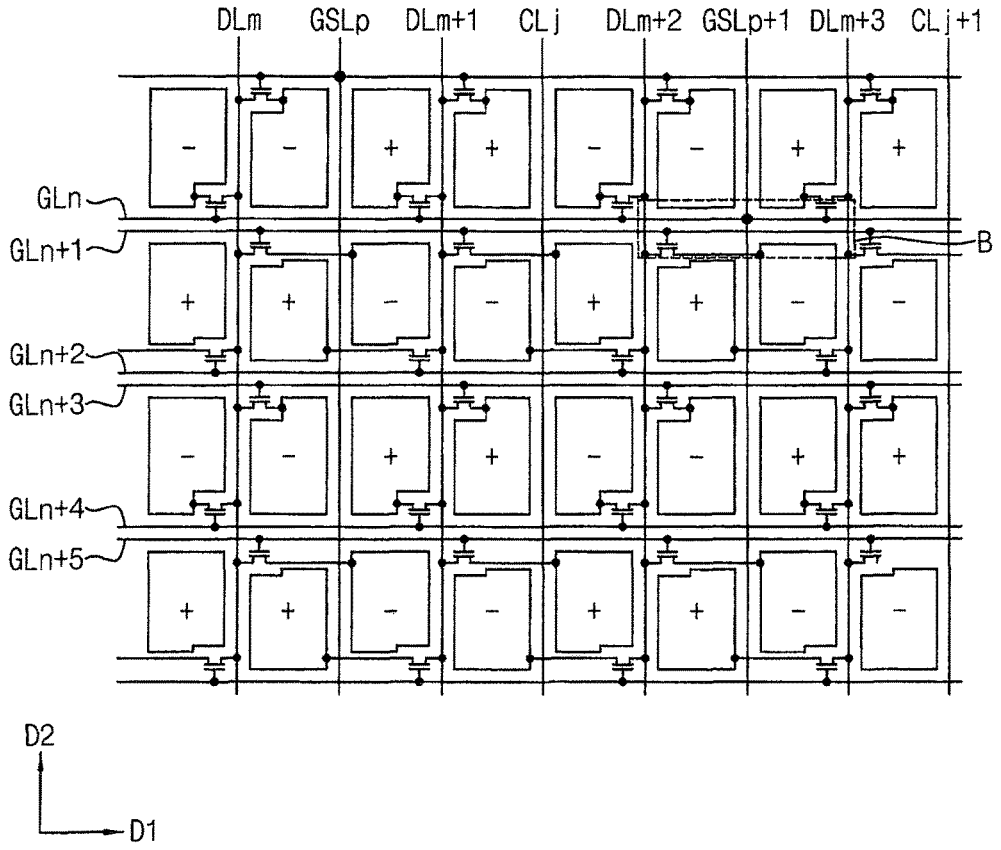
FIG. 6 is a schematic diagram illustrating a structure of pixels of a display apparatus according to an exemplary embodiment of the present inventive concept.

FIG. 6 is a schematic diagram illustrating a structure of pixels of a display apparatus according to an exemplary embodiment of the present inventive concept.

Referring to FIG. 6, a display apparatus according to an exemplary embodiment of the present inventive concept includes a plurality of pixels arranged along a column direction and a row direction (e.g., arranged in a matrix) and disposed in a display area, a plurality of gate lines GLn extending in a first direction D1 and connected with the pixels, a plurality of data lines DLm extending in a second direction D2 crossing the first direction D1 and connected with the pixels, a plurality of gate signal lines GSLp extending in the second direction D2 and connected with the gate lines GLn, and a plurality of common lines CLj extending in the second direction D2.

The gate lines GLn extend in the first direction D1 and are arranged along the second direction D2. Two gate lines may be disposed between the pixel rows. For example, an n-th gate line ('n' is a natural number) and an (n+1)-th gate line are disposed between the two adjacent pixel rows (e.g., are disposed between the two adjacent same pixel rows). The gate lines GLn may have a single layer structure including copper (Cu), silver (Ag), chromium (Cr), molybdenum (Mo), aluminum (Al), titanium (Ti), manganese (Mn), or a combination thereof. In addition, the gate lines GLn may have a multi-layer structure having a plurality of layers including materials different from each other. For example, the gate lines GLn may include a copper layer and a titanium layer disposed on and/or under the copper layer.

The data lines DLm extend in the second direction D2 crossing the gate lines GLn. The data lines DLm are disposed after every two pixel columns. In other words, adjacent data lines are separated from each other by two pixel columns (e.g., two pixel columns share each of the data lines DLm). One of the data lines DLm is connected with pixels of a k-th column ('k' is a natural number) and a (k+1)-th column in an odd-numbered row and connected with pixels of a (k−1)-th column and a (k+2)-th column in an even-numbered row. The data lines DLm may have a single layer structure including copper (Cu), silver (Ag), chromium (Cr), molybdenum (Mo), aluminum (Al), titanium (Ti), manganese (Mn), or a combination thereof. In addition, the data lines DLm may have a multi-layer structure having a plurality of layers including materials different from each other. For example, the data lines DLm may include a copper layer and a titanium layer disposed on and/or under the copper layer.

An m-th data line is connected with pixels of a k-th column ('k' is a natural number) and a (k+1)-th column in an odd-numbered row and is connected with pixels of a (k−1)-th column and a (k+2)-th column in an even-numbered row. During each frame, a data signal having a first polarity is applied to the m-th data line, and data signals having a second polarity are applied to an (m−1)-th data line and an (m+1)-th data line adjacent to the m-th data line. Accordingly, data voltages having different (e.g., alternating) polarities, such as in a sequence of "−, +, −, +", are applied to each pixel column, and data voltages having different polarities, such as in a sequence of "+, +, −, −, +, +, −, −", are applied to each pixel row. One-dot inversion is performed on the display panel 100 along a shorter side direction thereof in accordance with the pixel structure, and two-dot inversion is performed on the display panel 100 along a longer side direction.

The gate signal lines GSLp extend in a direction parallel with the data lines DLm. The gate lines GLn extend in a direction crossing an extension direction of the data lines DLm. The gate signal lines GSLp transfer the gate signals from the gate driver 250 to the gate lines GLn. The gate signal lines GSLp are disposed between the pixel columns in which the data lines DLm are not disposed. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer.

The common lines CLj extend in the second direction D2. A common voltage is applied to the common lines CLj. The common lines CLj are disposed between the pixel columns in which the data lines DLm are not disposed. The common lines CLj may have a single layer structure including copper (Cu), silver (Ag), chromium (Cr), molybdenum (Mo), aluminum (Al), titanium (Ti), manganese (Mn), or a combination thereof. In addition, the common lines CLj may have a multi-layer structure having a plurality of layers including materials different from each other. For example, the common lines CLj may include a copper layer and a titanium layer disposed on and/or under the copper layer.

The data lines DLm, the gate signal lines GSLp, and the common lines CLj are disposed between the pixels one by one. In addition, the data lines DLm, the gate signal lines GSLp, the data lines DLm, and the common lines CLj are disposed sequentially. That is, data lines DLm are disposed every two pixel columns and gate signal lines GSLp and common lines CLj are disposed every four pixel columns.

Figure 7:
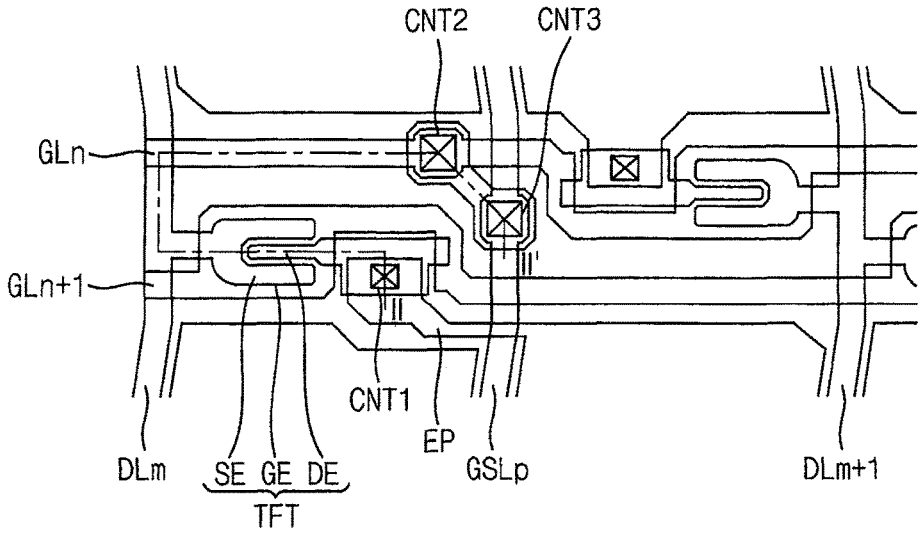
FIG. 7 is a plan view magnifying the portion "B" of FIG. 6.
Figure 8:
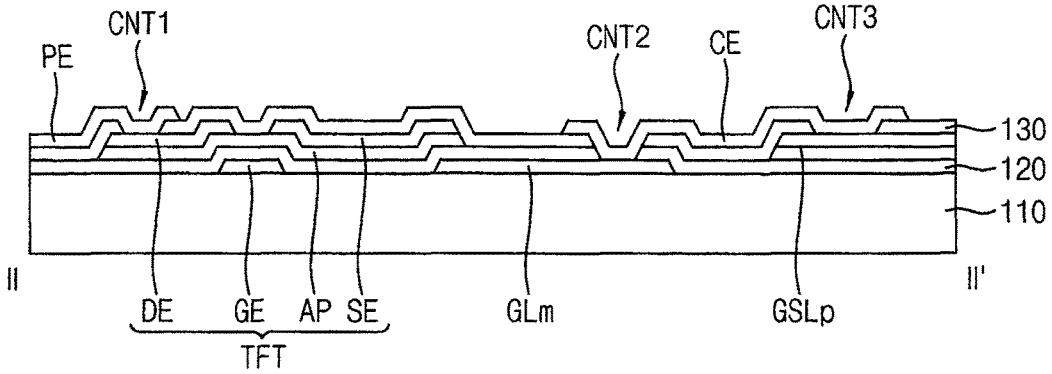
FIG. 8 is a cross-sectional view taken along the line II-II' of FIG. 7.

FIG. 7 is a plan view magnifying the portion "B" of FIG. 6. FIG. 8 is a cross-sectional view taken along the line II-II' of FIG. 7.

Referring to FIGS. 7 and 8, a display apparatus according to an exemplary embodiment of the present inventive concept includes a plurality of gate lines GLn, a plurality of data lines DLm, a plurality of switching elements TFT, a plurality of gate signal lines, and a plurality of pixel electrodes PE. Each of the switching elements TFT may include a gate electrode GE, a source electrode SE, and a drain electrode DE.

The gate lines GLn and the gate electrodes GE are formed on a base substrate 110. For example, a gate metal layer is formed on the base substrate 110 and patterned to form the gate lines GLn and the gate electrodes GE. The gate metal pattern may include the gate lines GLn and the gate electrodes GE.

Examples of the base substrate 110 may include a glass substrate, a quartz substrate, a silicon substrate, a plastic substrate, and the like.

The gate lines GLn extend in the first direction D1. The gate lines GLn may have a single layer structure including copper (Cu), silver (Ag), chromium (Cr), molybdenum (Mo), aluminum (Al), titanium (Ti), manganese (Mn), or a combination thereof. In addition, the gate lines GLn may have a multi-layer structure having a plurality of layers including materials different from each other. For example, the gate lines GLn may include a copper layer and a titanium layer disposed on and/or under the copper layer. The gate lines GLn are electrically connected to the gate electrodes GE of the switching elements TFT. In addition, portions of the gate lines GLn may form the gate electrodes GE.

The first insulation layer 120 is formed on the gate line GLn and the gate electrode GE. The first insulation layer 120 may include an inorganic material, such as silicon oxide ($SiO_x$) and/or silicon nitride ($SiN_x$). For example, in one embodiment, the first insulation layer 120 includes silicon oxide ($SiO_x$) and may have a thickness of about 500 Å. In addition, the first insulation layer 120 may include a plurality of layers including different materials from each other.

The active pattern AP is formed on the first insulation layer 120. The active pattern AP may include a semiconductor pattern and an ohmic contact pattern. The ohmic contact pattern is formed on the semiconductor pattern. The semiconductor pattern may include a silicon semiconductor material. For example, the semiconductor pattern may include amorphous silicon (a-Si:H). The ohmic contact pattern may be interposed between the semiconductor pattern and a source electrode SE and may be interposed between the semiconductor pattern and a drain electrode DE. The ohmic contact pattern may include n+ amorphous silicon (n+a-Si:H).

The data metal pattern may be disposed on the active pattern AP. The data metal pattern may include the data line DL, the source electrode SE, and the drain electrode DE. The data metal pattern may have a single layer structure including copper (Cu), silver (Ag), chromium (Cr), molybdenum (Mo), aluminum (Al), titanium (Ti), manganese (Mn), or a combination thereof. In addition, the data metal pattern may have a multi-layer structure having a plurality of layers including materials different from each other.

The gate signal lines GSLp are disposed on the same layer as the data lines DLm. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer. The gate signal lines GSLp extend in a direction parallel with an extension direction of the data lines DLm.

A second insulation layer 130 may be formed on the data metal pattern. The second insulation layer 130 may include an inorganic material, such as silicon oxide ($SiO_x$) and/or silicon nitride ($SiN_x$). For example, in one embodiment, the second insulation layer 130 includes silicon oxide ($SiO_x$) and may have a thickness of about 500 Å. In addition, the second insulation layer 130 may include a plurality of layers including different materials from each other.

The pixel electrode PE and a connecting electrode CE are formed on the second insulation layer 130.

The pixel electrode PE may include a transparent conductive material, such as indium tin oxide (ITO) and/or indium zinc oxide (IZO). In addition, the pixel electrode PE may include titanium (Ti) and/or molybdenum titanium (MoTi). The pixel electrode PE is electrically connected with the drain electrode DE through a first contact opening CNT1. The first contact opening CNT1 is formed through the second insulation layer 130.

The connecting electrode CE may include a transparent conductive material, such as indium tin oxide (ITO) and/or indium zinc oxide (IZO). In addition, the connecting electrode CE may include titanium (Ti) and/or molybdenum titanium (MoTi). The connecting electrode CE connects the gate line GLn and the gate signal line GSLp through a second contact opening CNT2 and a third contact opening CNT3. The second contact opening CNT2 is formed through the first insulation layer 120 and the second insulation layer 130. The third contact opening CNT3 is formed through the second insulation layer 130.

According to the present exemplary embodiment, the gate signal lines GSLp are disposed between the pixel columns in which the data lines DLm are not disposed. The gate signal lines GSLp extend in the second direction D2, parallel with a extension direction of the data lines DLm. In addition, the gate signal lines GSLp are disposed on the same layer as the data lines DLm and are electrically connected with the gate lines GLn. Thus, the gate signal lines GSLp transfer the gate signals from the gate driver to the gate lines GLn.

Therefore, the data driver and the gate driver are disposed in the first peripheral area adjacent to a first longer side of the display area. In addition, no driver is disposed in the second peripheral area, the third peripheral area, or the fourth peripheral area. Thus, widths of the second peripheral area, the third peripheral area, and the fourth peripheral area may be reduced (e.g., narrowed). Accordingly, widths of three sides of a display panel may be reduced or minimized.

Figure 9:
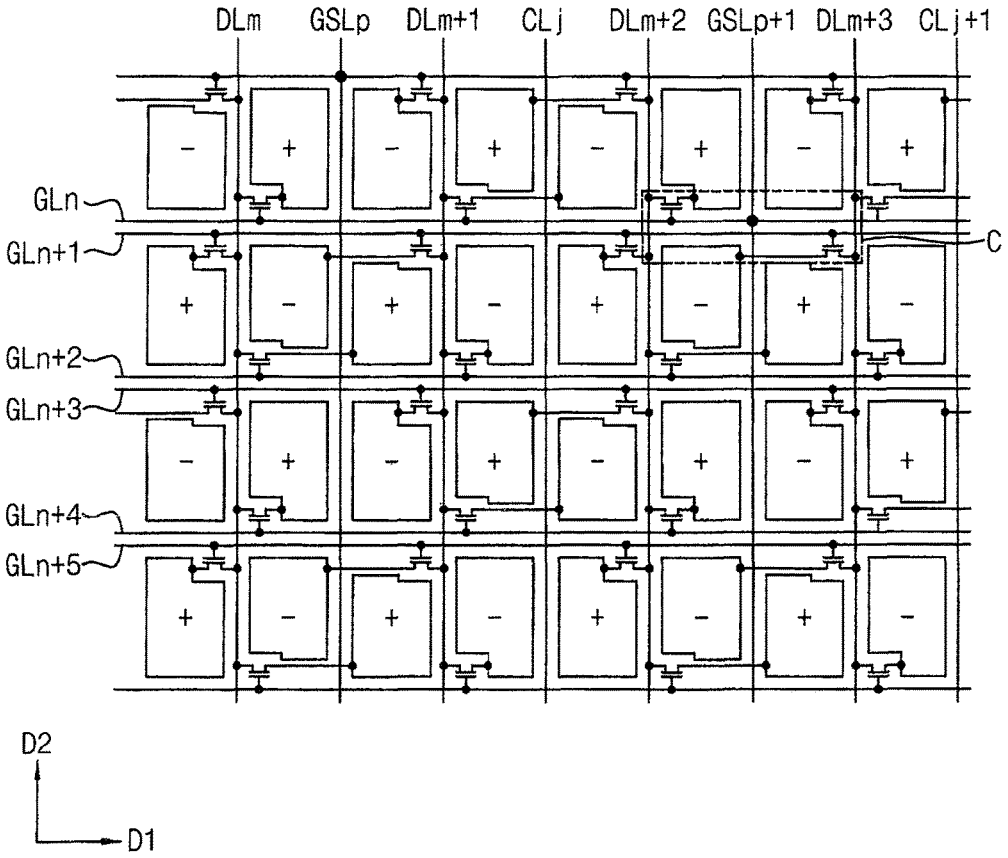
FIG. 9 is a schematic diagram illustrating a structure of pixels of a display apparatus according to an exemplary embodiment of the present inventive concept.

FIG. 9 is a schematic diagram illustrating a structure of pixels of a display apparatus according to an exemplary embodiment of the present inventive concept.

Referring to FIG. 9, a display apparatus according to an exemplary embodiment of the present inventive concept includes a plurality of pixels arranged along a column direction and a row direction (e.g., in a matrix) and disposed in a display area, a plurality of gate lines GLn extending in a first direction D1 and connected with the pixels, a plurality of data lines DLm extending in a second direction D2 crossing the first direction D1 and connected with the pixels, a plurality of gate signal lines GSLp extending in the second direction D2 and connected with the gate lines GLn, and a plurality of common lines CLj extending in the second direction D2.

The gate lines GLn extend in the first direction D1 and are arranged along the second direction D2. Two gate lines may be disposed between the pixel rows. For example, an n-th gate line ('n' is a natural number) and an (n+1)-th gate line are disposed between the same two pixel row. The gate lines GLn may have a single layer structure including copper (Cu), silver (Ag), chromium (Cr), molybdenum (Mo), aluminum (Al), titanium (Ti), manganese (Mn), or a combination thereof. In addition, the gate lines GLn may have a multi-layer structure having a plurality of layers including materials different from each other. For example, the gate lines GLn may include a copper layer and a titanium layer disposed on and/or under the copper layer.

The data lines DLm extend in the second direction D2 crossing the gate lines GLn. The data lines DLm are disposed after every two pixel columns. In other words, the adjacent data lines are separated from each other by two pixel columns. An m-th data line DLm ('m' is a natural number) is connected with pixels of a (k−1)-th column ('k' is a natural number) and a (k+1)-th column in an odd-numbered row and connected with pixels of a k-th column and a (k+2)-th column in an even-numbered row. In addition, an (m+1)-th data line DLm+1 is connected with pixels of a (k+2)-th column and an (k+4)-th column in an odd-numbered row and connected with pixels of a (k+1)-th column and a (k+3)-th column in an even-numbered row. The data lines DLm may have a single layer structure including copper (Cu), silver (Ag), chromium (Cr), molybdenum (Mo), aluminum (Al), titanium (Ti), manganese (Mn), or a combination thereof. In addition, the data lines DLm may have a multi-layer structure having a plurality of layers including materials different from each other. For example, the data lines DLm may include a copper layer and a titanium layer disposed on and/or under the copper layer.

An m-th data line is connected with pixels of a (k−1)-th column and a (k+1)-th column in an odd-numbered row and connected with pixels of a k-th column and a (k+2)-th column in an even-numbered row. In addition, an (m+1)-th data line DLm+1 is connected with pixels of a (k+2)-th column and a (k+4)-th column in an odd-numbered row and connected with pixels of a (k+1)-th column and a (k+3)-th column in an even-numbered row. In each frame, a data signal having a first polarity is applied to the m-th data line, and data signals having a second polarity are applied to an (m−1)-th data line and an (m+1)-th data line adjacent to the m-th data line. Accordingly, data voltages having different (e.g., alternating) polarities, such as in a sequence of "−, +, −, +", are applied to each pixel column, and data voltages having different polarities, such as in a sequence of "+, −, +, −, +, −, +, −", are applied to each pixel row. One-dot inversion is performed on the display panel 100 along a longer side direction thereof in accordance with the pixel structure, and one-dot inversion is performed on the display panel 100 along a shorter side direction The gate signal lines GSLp extend in a direction parallel with an extension direction of the data lines DLm. The gate lines GLn extend in a direction crossing an extension direction of the data lines DLm. The gate signal lines GSLp transfer the gate signals from the gate driver 250 to the gate lines GLn. The gate signal lines GSLp are disposed between the pixel columns in which the data lines DLm are not disposed. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer.

The common lines CLj extend in the second direction D2. A common voltage is applied to the common lines CLj. Ones of the common lines CLj are disposed between the pixel columns in which the data lines DLm are not disposed. The common lines CLj may have a single layer structure including copper (Cu), silver (Ag), chromium (Cr), molybdenum (Mo), aluminum (Al), titanium (Ti), manganese (Mn), or a combination thereof. In addition, the common lines CLj may have a multi-layer structure having a plurality of layers including materials different from each other. For example, the common lines CLj may include a copper layer and a titanium layer disposed on and/or under the copper layer.

The data lines DLm, the gate signal lines GSLp, and the common lines CLj are disposed between the pixels one by one. In addition, one of the data lines DLm, one of the gate signal lines GSLp, another of the data lines DLm+1, and one of the common lines CLj are disposed sequentially. That is, the data lines DLm are disposed every two pixel columns, and the gate signal lines GSLp and the common lines CLj are disposed every four pixel columns.

Figure 10:
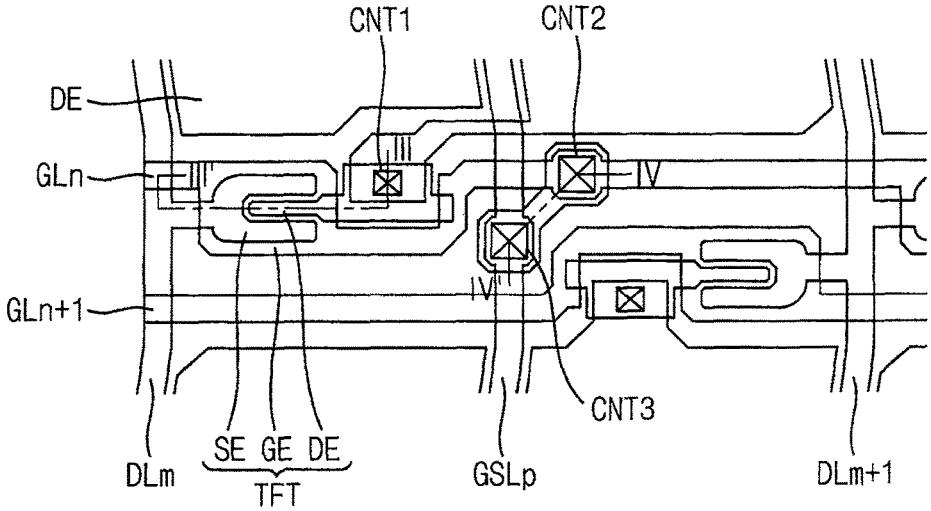
FIG. 10 is a plan view magnifying the portion "C" of FIG. 9.
Figure 11:
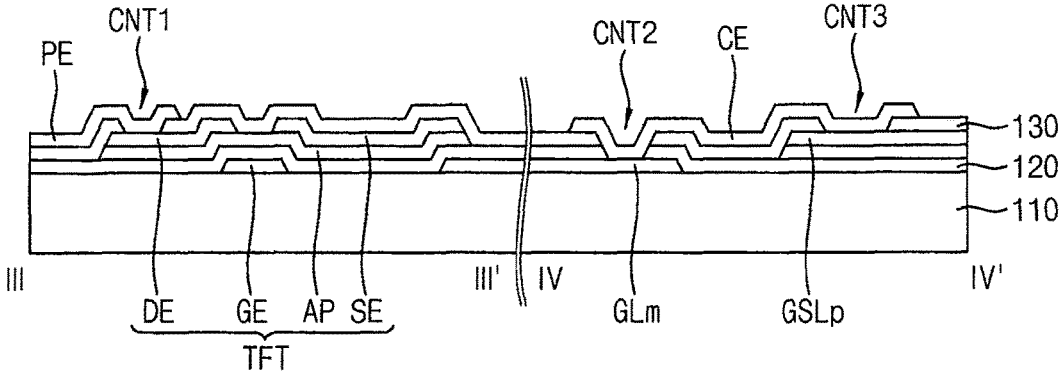
FIG. 11 is a cross-sectional view taken along the lines III-III' and IV-IV' of FIG. 10.

FIG. 10 is a plan view magnifying the portion "C" of FIG. 9. FIG. 11 is a cross-sectional view taken along the lines and IV-IV' of FIG. 10.

Referring to FIGS. 10 and 11, a display apparatus according to an exemplary embodiment of the present inventive concept includes a plurality of gate lines GLn, a plurality of data lines DLm, a plurality of switching elements TFT, a plurality of gate signal lines GSLp, and a plurality of pixel electrodes PE. Each of the switching elements TFT may include a gate electrode GE, a source electrode SE, and a drain electrode DE.

The gate lines GLn and the gate electrodes GE are formed on a base substrate 110. For example, a gate metal layer is formed on the base substrate 110 and patterned to form the gate lines GLn and the gate electrodes GE. The gate metal pattern may include the gate lines GLn and the gate electrodes GE.

Examples of the base substrate 110 may include a glass substrate, a quartz substrate, a silicon substrate, a plastic substrate, and the like.

The gate lines GLn extend in the first direction D1. The gate lines GLn may have a single layer structure including copper (Cu), silver (Ag), chromium (Cr), molybdenum (Mo), aluminum (Al), titanium (Ti), manganese (Mn), or a combination thereof. In addition, the gate line GLn may have a multi-layer structure having a plurality of layers including materials different from each other. For example, the gate lines GLn may include a copper layer and a titanium layer disposed on and/or under the copper layer. The gate lines GLn are electrically connected to the gate electrodes GE of the switching elements TFT. In addition, portions of the gate lines GLn may form the gate electrodes GE.

The first insulation layer 120 is formed on the gate line GLn and the gate electrode GE. The first insulation layer 120 may include an inorganic material, such as silicon oxide ($SiO_x$) and/or silicon nitride ($SiN_x$). For example, in one embodiment, the first insulation layer 120 includes silicon oxide ($SiO_x$) and may have a thickness of about 500 Å. In addition, the first insulation layer 120 may include a plurality of layers including different materials from each other.

An active pattern AP is formed on the first insulation layer 120. The active pattern AP may include a semiconductor pattern and an ohmic contact pattern. The ohmic contact pattern is formed on the semiconductor pattern. The semiconductor pattern may include a silicon semiconductor material. For example, the semiconductor pattern may include amorphous silicon (a-Si:H). The ohmic contact pattern may be interposed between the semiconductor pattern and a source electrode SE and may be interposed between the semiconductor pattern and a drain electrode DE. The ohmic contact pattern may include n+ amorphous silicon (n+a-Si:H).

The data metal pattern may be disposed on the active pattern AP. The data metal pattern may include the data line DL, the source electrode SE, and the drain electrode DE. The data metal pattern may have a single layer structure including copper (Cu), silver (Ag), chromium (Cr), molybdenum (Mo), aluminum (Al), titanium (Ti), manganese (Mn), or a combination thereof. In addition, the data metal pattern may have a multi-layer structure having a plurality of layers including materials different from each other.

The gate signal lines GSLp are disposed on the same layer as the data lines DLm. The gate signal lines GSLp may have a single layer structure including copper (Cu), silver (Ag), chromium (Cr), molybdenum (Mo), aluminum (Al), titanium (Ti), manganese (Mn), or a combination thereof. In addition, the gate signal lines GSLp may have a multi-layer structure having a plurality of layers including materials different from each other. For example, the gate signal lines GSLp may include a copper layer and a titanium layer disposed on and/or under the copper layer. The gate signal lines GSLp extend in a direction parallel with an extension direction of the data lines DLm.

A second insulation layer 130 may be formed on the data metal pattern. The second insulation layer 130 may include an inorganic material, such as silicon oxide ($SiO_x$) and/or silicon nitride ($SiN_x$). For example, in one embodiment, the second insulation layer 130 includes silicon oxide ($SiO_x$), and may have a thickness of about 500 Å. In addition, the second insulation layer 130 may include a plurality of layers including different materials from each other.

The pixel electrode PE and a connecting electrode CE are formed on the second insulation layer 130.

The pixel electrode PE may include a transparent conductive material, such as indium tin oxide (ITO) and/or indium zinc oxide (IZO). In addition, the pixel electrode PE may include titanium (Ti) and/or molybdenum titanium (MoTi). The pixel electrode PE is electrically connected with the drain electrode DE through a first contact opening CNT1. The first contact opening CNT1 is formed through the second insulation layer 130.

The connecting electrode CE may include a transparent conductive material, such as indium tin oxide (ITO) and/or indium zinc oxide (IZO). In addition, the connecting electrode CE may include titanium (Ti) and/or molybdenum titanium (MoTi). The connecting electrode CE connects one of the gate lines GLn and the gate signal line GSLp through a second contact opening CNT2 and a third contact opening CNT3. The second contact opening CNT2 is formed through the first insulation layer 120 and the second insulation layer 130. The third contact opening CNT3 is formed through the second insulation layer 130.

According to the present exemplary embodiment, the gate signal lines GSLp are disposed between the pixel columns in which the data lines DLm are not disposed. The gate signal lines GSLp extend in the second direction D2 parallel with an extension direction of the data lines DLm. In addition, the gate signal lines GSLp are disposed on the same layer as the data lines DLm and are electrically connected with the gate lines GLn. Thus, the gate signal lines GSLp transfer the gate signals froth the gate driver to the gate lines GLn.

Therefore, the data driver and the gate driver are disposed in the first peripheral area adjacent to a first longer side of the display area. In addition, no driver is disposed in the second peripheral area, the third peripheral area, or the fourth peripheral area. Thus, widths of the second peripheral area, the third peripheral area, and the fourth peripheral area may be reduced (e.g., narrowed). Accordingly, widths of three sides of a display panel may be reduced or minimized.

According to the present exemplary embodiment, a display apparatus includes a plurality of gate signal lines extending in a direction parallel with an extension direction of a plurality of data lines. The gate signal lines are disposed on the same layer as the data lines. The gate signal lines transfer gate signals to gate lines. Thus, a gate driver and a data driver may both be disposed on a peripheral area adjacent to a first longer side of the display area.

In addition, the data driver and the gate driver are disposed in the first peripheral area adjacent to a first longer side of the display area. In addition, no driver is disposed in the second peripheral area, the third peripheral area, or the fourth peripheral area. Thus, widths of the second peripheral area, the third peripheral area, and the fourth peripheral area may be reduced (e.g., narrowed). Accordingly, widths of three sides of a display panel may be reduced or minimized.

The foregoing is illustrative of the present invention and is not to be construed as limiting thereof. Although a few exemplary embodiments of the present invention have been described, those skilled in the art will readily appreciate that many modifications are possible to the presented exemplary embodiments without materially departing from the teachings and characteristics of the present invention. Accordingly, all such modifications are intended to be included within the scope of the present invention as defined in the claims and their equivalents. In the claims, means-plus-function clauses are intended to cover the structures described herein as performing the recited function and, not only structural equivalents, but also equivalent structures. Therefore, it is to be understood that the foregoing is illustrative of the present invention and is not to be construed as limiting the same to the specific exemplary embodiments disclosed and that modifications to the disclosed exemplary embodiments, as well as other exemplary embodiments, are intended to be included within the scope of the appended claims and their equivalents. The present inventive concept is defined by the following claims, with equivalents of the claims to be included therein.

What is claimed is:

1. A display apparatus comprising:

a plurality of pixels arranged in columns and rows in a display area;

a data line extending in a first direction and connected with pixels in a k-th column ('k' is a natural number) and a (k+1)-th column;

a gate line extending in a second direction crossing the first direction and connected with ones of the pixels;

a gate signal line extending in the first direction and connected with the gate line;

a gate driver configured to apply a gate signal to the gate line; and a first peripheral area adjacent to a first longer side of the display area and having a first width, a second peripheral area adjacent to a second longer side opposite the first longer side of the display area and having a second width, a third peripheral area adjacent to a first shorter side extending between the first longer side and the second longer side of the display area, and a fourth peripheral area adjacent to a second shorter side and extending between the first longer side and the second longer side of the display area, wherein the gate driver is in the first peripheral area.

2. The display apparatus of claim 1, wherein the first width is greater than the second width.

3. The display apparatus of claim 1, wherein the gate signal line is at the same layer as the data line.

4. The display apparatus of claim 3, further comprising:

a common line extending in the first direction and arranged between the pixels.

5. The display apparatus of claim 4, wherein the data line, the gate signal line, and the common line are sequentially arranged between adjacent pixel columns.

6. The display apparatus of claim 1, further comprising:

a data driver in the first peripheral area and configured to apply a data signal to the data line.

7. A display apparatus comprising:

a plurality of pixels arranged in columns and rows in a display area;

a data line extending in a first direction and connected with pixels of a k-th column ('k' is a natural number) and a (k+1)-th column in an odd-numbered row, and connected with pixels of a (k−1)-th column and a (k+2)-th column in an even-numbered row;

a gate line extending in a second direction crossing the first direction and connected with ones of the pixels;

a gate signal line extending in the first direction and connected with the gate line; and a gate driver in a first peripheral area adjacent to a first longer side of the display area and having a first width, and configured to apply a gate signal to the gate line.

8. The display apparatus of claim 7, further comprising:

a second peripheral area adjacent to a second longer side opposite the first longer side of the display area and having a second width;

a third peripheral area adjacent to a first shorter side extending between the first longer side and the second longer side of the display area; and a fourth peripheral area adjacent to a second shorter side extending between the first longer side and the second longer side of the display area.

9. The display apparatus of claim 8, wherein the first width is greater than the second width.

10. The display apparatus of claim 7, wherein the gate signal line is at the same layer as the data line.

11. The display apparatus of claim 7, further comprising:

a common line extending in the first direction and between the pixels.

12. The display apparatus of claim 11, wherein the data line, the gate signal line, and the common line are sequentially arranged between adjacent pixel rows.

13. The display apparatus of claim 7, further comprising:

a data driver in the first peripheral area and configured to apply a data signal to the data line.

14. A display apparatus comprising:

a plurality of pixels arranged in columns and rows in a display area;

an m-th data line ('cm' is a natural number) extending in a first direction, connected with pixels of a (k−1)-th column ('k' is a natural number) and a (k+1)-th column in an odd-numbered row, and connected with pixels of a k-th column and a (k+2)-th column in an even-numbered row;

an (m+1)-th data line connected with pixels of a (k+2)-th column and a (k+4)-th column in an odd-numbered row, and connected with pixels of a (k+1)-th column and a (k+3)-th column in an even-numbered row;

a gate line extending in a second direction crossing the first direction and connected with ones of the pixels;

a gate signal line extending in the first direction and connected with the gate line; and a gate driver in a first peripheral area adjacent to a first longer side of the display area and having a first width, and configured to apply a gate signal to the gate line.

15. The display apparatus of claim 14, further comprising:

a second peripheral area adjacent to a second longer side opposite the first longer side of the display area and having a second width;

a third peripheral area adjacent to a first shorter side extending between the first longer side and the second longer side of the display area; and a fourth peripheral area adjacent to a second shorter side extending between the first longer side and the second longer side of the display area.

16. The display apparatus of claim 15, wherein the first width is greater than the second width.

17. The display apparatus of claim 14, further comprising:

a common line extending in the first direction and between the pixels.

18. The display apparatus of claim 17, wherein the m-th data line, the gate signal line, and the common line are sequentially arranged between adjacent pixel rows.

19. The display apparatus of claim 14, further comprising:

a data driver in the first peripheral area and configured to apply a data signal to the data line.

* * * * *